US009702318B2

(12) United States Patent
Geyer

(10) Patent No.: US 9,702,318 B2
(45) Date of Patent: Jul. 11, 2017

(54) TWO-STROKE ENGINE

(71) Applicant: Andreas Stihl AG & Co. KG, Waiblingen (DE)

(72) Inventor: Werner Geyer, Berglen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 126 days.

(21) Appl. No.: 14/850,559

(22) Filed: Sep. 10, 2015

(65) Prior Publication Data

US 2016/0069296 A1 Mar. 10, 2016

(30) Foreign Application Priority Data

Sep. 10, 2014 (DE) ..... 10 2014 013 421

(51) Int. Cl.

| | |
|---|---|
| ***F02B 25/00*** | (2006.01) |
| ***F02F 7/00*** | (2006.01) |
| ***F02B 25/14*** | (2006.01) |
| ***F02B 75/02*** | (2006.01) |
| ***F02F 1/22*** | (2006.01) |
| ***F02B 25/20*** | (2006.01) |

(52) U.S. Cl.

CPC ..... *F02F 7/0039* (2013.01); *F02B 25/14* (2013.01); *F02B 25/20* (2013.01); *F02B 75/02* (2013.01); *F02F 1/22* (2013.01)

(58) Field of Classification Search

CPC . F02F 7/0039; F02F 1/22; F02B 25/20; F02B 25/14; F02B 75/02

See application file for complete search history.

(56) References Cited

U.S. PATENT DOCUMENTS

| | | | | |
|---|---|---|---|---|
| 2002/0179026 | A1* | 12/2002 | Laimbock | F02M 69/045 123/73 C |
| 2003/0111027 | A1* | 6/2003 | Schmidt | F02B 33/04 123/73 PP |
| 2008/0035096 | A1* | 2/2008 | Carlsson | F02B 25/22 123/193.2 |
| 2011/0146642 | A1* | 6/2011 | Geyer | B22C 9/10 123/73 PP |
| 2011/0146643 | A1 | 6/2011 | Geyer et al. | |

* cited by examiner

*Primary Examiner* — Hung Q Nguyen
(74) *Attorney, Agent, or Firm* — Walter Ottesen, P.A.

(57) ABSTRACT

A two-stroke engine has a cylinder with a combustion chamber formed therein. The combustion chamber is delimited by a piston. The cylinder has a base on which extends a partition plane whereat the cylinder is separated from a crankcase. The combustion chamber is, in at least one piston position, connected via at least one transfer channel to the crankcase interior. The transfer channel passes from the cylinder into the crankcase at at least one opening. A side wall of the transfer channel has, in the cylinder, a first region wherein the wall encloses an angle of 90° with the cylinder longitudinal axis. Between the first region and the opening as viewed in the cylinder circumferential direction is arranged a second wall region. The second region has a spacing, measured parallel to the cylinder longitudinal axis, to the partition plane. The spacing is greater than the spacing in the first region.

14 Claims, 7 Drawing Sheets

TWO-STROKE ENGINE

CROSS REFERENCE TO RELATED APPLICATION

This application claims priority of German patent application no. 10 2014 013 421.0, filed Sep. 10, 2014, the entire content of which is incorporated herein by reference.

BACKGROUND OF THE INVENTION

United States patent application publication 2011/0146643 discloses a two-stroke engine, the transfer channels of which have a side wall region running approximately perpendicular to the cylinder longitudinal axis. Proceeding from this region, the side wall slopes continuously downward in the direction of the crankcase as far as the outlet opening into the crankcase.

SUMMARY OF THE INVENTION

It is an object of the invention to provide a two-stroke engine which exhibits low exhaust-gas values and is of reduced structural size.

The two-stroke engine of the invention includes: a cylinder defining a cylinder longitudinal axis and having a combustion chamber formed therein; a piston mounted in a reciprocating manner; the combustion chamber having an outlet and being delimited by the piston; a crankcase defining a crankcase interior space; a crankshaft rotatably mounted about a rotational axis in the crankcase; the piston being configured to drive the crankshaft; the cylinder having a cylinder base whereat the cylinder base and the crankcase conjointly define a partition plane separating the cylinder from the crankcase; the two-stroke engine defining an imaginary central plane which contains the rotational axis and intersects the outlet; at least one transfer channel having at least one side wall; the combustion chamber being fluidly connected to the crankcase interior space via the at least one transfer channel in at least one position of the piston; the at least one transfer channel passing from the cylinder to the crankcase via at least one transfer opening; the at least one side wall having a first region in the cylinder; the at least one side wall in the first region in a viewing direction perpendicular to the imaginary plane encloses an angle $\alpha$ of 90° with the cylinder longitudinal axis; the first region of the side wall having a first distance (a, d) to the partition plane measured parallel to the cylinder longitudinal axis; the at least one side wall having a second region running in a cylinder circumferential direction between the first region and the transfer opening; the second region being at a second distance (b, e) to the partition plane measured parallel to the cylinder longitudinal axis; and, the second distance (b, e) being greater than the first distance (a, d).

It is provided that the side wall of the transfer channel has, between the first region and the transfer opening in the cylinder circumferential direction, a second region, the spacing of which to the partition plane is greater than the spacing of the first region to the partition plane. The spacing of the side wall of the transfer channel to the partition plane and to the crankcase accordingly increases once again between the first region and the transfer opening. The transfer channel does not run in the direction of the crankcase, that is, in downwardly sloping fashion, proceeding from the transfer window to the transfer opening, but rather moves away from the partition plane once again proceeding from the first region to the transfer opening. In this way, a relatively large length of the transfer channel is realized with a small structural size of the cylinder. It has furthermore been found that expedient scavenging of the combustion chamber is achieved in this way. The length of the transfer channel can, owing to the provided shape, be adapted and coordinated in an effective manner, without the imperative need for the structural size of the cylinder to be increased.

It is advantageously the case that at least one transfer channel is closed off to the outside of the cylinder by at least one cover. In this way, it is possible for the cylinder to be produced in a die casting process. The region of the transfer channels, which is closed off by the cover, can be demolded in an outward direction, that is, in a plane perpendicular to the cylinder longitudinal axis. Toward the cylinder interior space, the transfer channels are advantageously delimited by the cylinder itself. That section of the transfer channel which adjoins the transfer opening and which is formed in the cylinder base advantageously runs approximately parallel to the cylinder longitudinal axis. The section may in this case also widen in the direction of the partition plane. In this way, in the case of the cylinder being produced by die casting, demolding is possible in a downward direction, that is, in the direction of the crankcase.

In order that the transfer channels can be demolded in a simple manner in the die casting process, it is provided that, in a side view of the cylinder with a viewing direction perpendicular to the central plane of the cylinder, the cover extends at least as far as an imaginary line which forms the elongation of the vertical edge, averted from the cylinder interior space, of that section of the transfer channel which is formed in the cylinder base. The section which adjoins the transfer opening and which runs parallel to the cylinder longitudinal axis can thereby be demolded with a core that is pulled downward parallel to the cylinder longitudinal axis. The adjoining section of the transfer channel is advantageously laterally covered entirely by the cover, such that the section of the transfer channel can be demolded laterally, that is, with a core that is pulled outward perpendicular to the cylinder longitudinal axis. A slightly oblique pulling direction of the cores may also be advantageous.

The cover advantageously has an encircling sealing edge which is arranged on an encircling sealing edge of the cylinder. In this way, good sealing of the cover with respect to the cylinder can be achieved. It is particularly advantageously the case that one of the sealing edges has a groove into which a web of the other sealing edge projects. A stepped form of the sealing edges may also be advantageous in order to realize a labyrinthine seal. The cover is in this case in particular adhesively bonded to the cylinder. This yields a simple construction and simple assembly. The cylinder base advantageously has a top side averted from the partition plane. In the case of a vertically arranged cylinder longitudinal axis and a combustion chamber arranged above the crankcase, the sealing edge of the cylinder advantageously runs entirely above the top side of the cylinder base. The sealing edge of the cylinder accordingly does not project into the region of the cylinder base. In this way, a weakening of the cylinder base by the sealing edge is prevented. It may however also be provided that the sealing edge of the cylinder projects into the region of the cylinder base. In this way, it is possible to realize a small structural height of the cylinder with a relatively large length of the transfer channel.

To achieve low exhaust-gas values of the two-stroke engine, it is provided that the two-stroke engine has at least two transfer channels arranged on one side of the central plane, which transfer channels are merged in the cylinder and pass over into the crankcase interior space at a common outlet opening. A simple construction is obtained if two transfer channels arranged on one side of the central plane are closed off by a common cover. A sealing edge is advantageously formed between the cover and cylinder, which sealing edge separates the two transfer channels at least over a section of the length. The sealing edge is advantageously in the form of an adhesive gap and at least partially filled with adhesive. A good sealing action between the transfer channels is achieved in this way. The transport channels advantageously have a common section which is at least partially delimited by the cover.

To achieve good scavenging results and thus low exhaust-gas values, it is advantageously provided that the two-stroke engine has at least two transfer channels arranged symmetrically with respect to the central plane. It is advantageously the case that at least two transfer channels arranged on opposite sides of the central plane pass over into the crankcase at a common transfer opening. It is preferably the case that all transfer channels of the cylinder pass over into the crankcase at a common transfer opening and issue into the crankcase interior space at a common outlet opening. In this way, the transfer channels can, in a simple manner, be formed with a large length. It has been found that particularly good scavenging of the combustion chamber, and thus very low exhaust-gas values, can be realized in this way. It is advantageously the case that at least one transfer channel in the cylinder at least partially runs in helically coiled fashion around the cylinder longitudinal axis. A helically coiled profile of the transfer channel is in this case a profile of the transfer channel in the case of which the transfer channel, over a section of its length, is guided both in the direction of the cylinder longitudinal axis and in the circumferential direction around the cylinder longitudinal axis, that is, the longitudinal central axis of the transfer channel runs obliquely with respect to the cylinder longitudinal axis in a side view of the cylinder. In this section, the transfer channel may for example run in helically coiled fashion. A non-uniform coiled form may also be provided.

The partition plane advantageously runs perpendicular to the cylinder longitudinal axis and is arranged between the axis of rotation of the crankshaft and the combustion chamber. The partition plane accordingly does not intersect the axis of rotation of the crankshaft, but is arranged on that side of the axis of rotation of the crankshaft which faces toward the combustion chamber. The crankshaft is in particular rotatably mounted in the crankcase by way of at least one crankshaft bearing, and the partition plane runs on that side of the crankshaft bearing which faces toward the combustion chamber, and the partition plane does not intersect the crankshaft bearing. The crankshaft bearing is accordingly arranged entirely in the crankcase. The cylinder does not extend as far as the crankshaft bearing. In particular in the case of two-stroke engines in which the partition plane between the crankcase and cylinder runs above the crankshaft bearing, the provided profile of the transfer channels is advantageous because the cylinder has only a relatively small length owing to the position of the parting plane.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
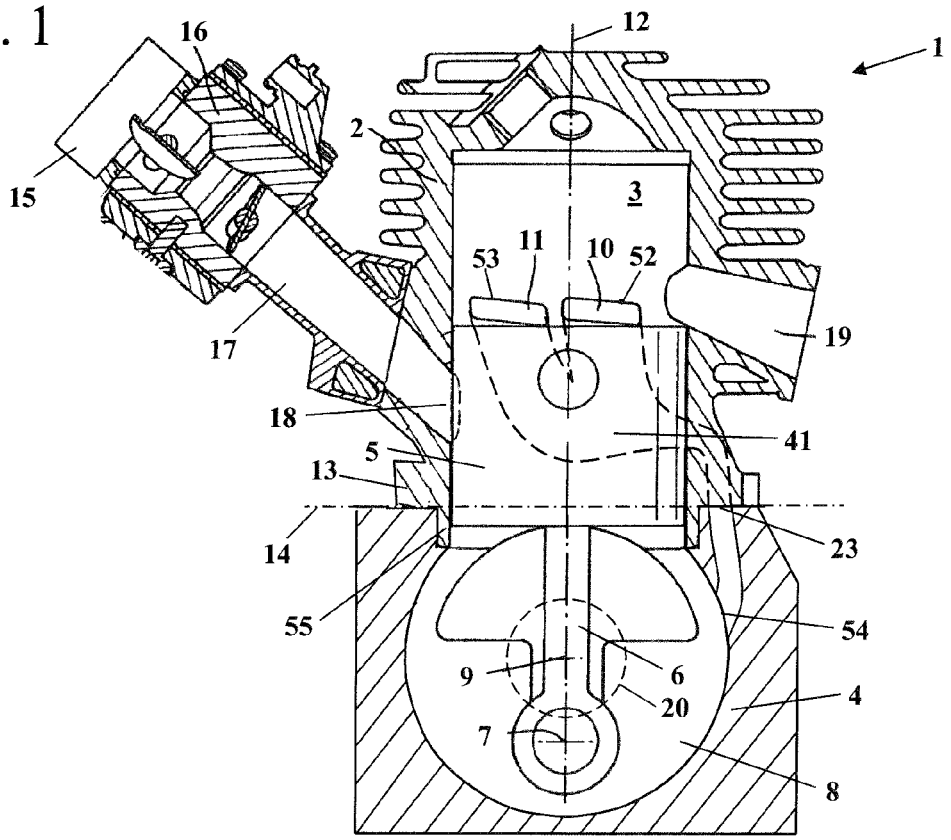
FIG. 1 is a schematic, in section, of a two-stroke engine.

FIG. 1 schematically shows a two-stroke engine 1 which has a cylinder 2. In the cylinder 2 there is formed the combustion chamber 3 which is delimited by a piston 5 which is mounted in the cylinder 2 so as to perform reciprocating movements. The piston 5, via a connecting rod 6, drives a crankshaft 7 which is mounted in a crankcase 4 so as to be rotatable about an axis of rotation 9. The crankshaft 7 projects through a crankcase interior space 8 which is formed in the crankcase 4. The crankshaft 7 is rotatably mounted by way of crankshaft bearings 20, which are schematically shown in FIG. 1. As shown in FIG. 1, the partition plane runs on that side of the crankshaft bearing 20 which faces toward the combustion chamber 5, and the partition plane does not intersect the crankshaft bearing 20. The cylinder 2 has a cylinder base 13 which is mounted onto the crankcase 4 at a partition plane 14. The cylinder 2 has a collar 55 which projects across the partition plane 14 into the crankcase 4.

The two-stroke engine 1 has a carburetor 16 which draws in combustion air via an air filter 15 which is schematically shown in FIG. 1. Fuel is supplied to the combustion air in the carburetor 16. The fuel/air mixture is drawn via an intake channel 17 into the crankcase interior space 8. The intake channel 17 opens into the crankcase interior space 8 by way of an inlet 18 on the cylinder bore, wherein the inlet 18 is controlled by the piston 5. The crankcase interior space 8 is connected via transfer channels 10, 11 to the combustion chamber 3 in the region of bottom dead center of the piston 5, as shown in FIG. 1. An outlet 19 leads out of the combustion chamber, which outlet is likewise controlled by the piston 5. The piston 5 moves in the cylinder 2 in the direction of a cylinder longitudinal axis 12.

Figure 4:
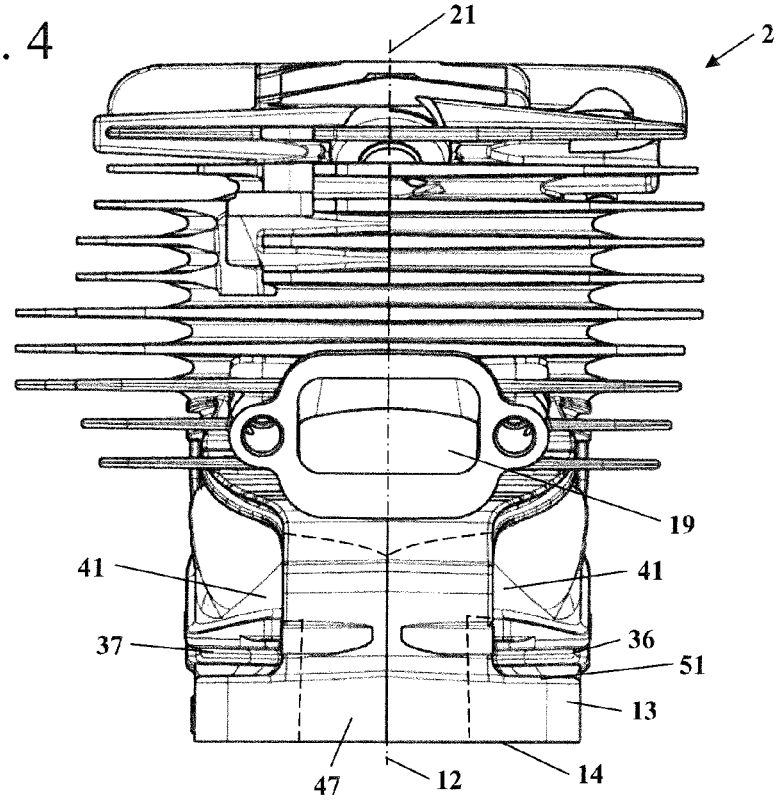
FIG. 4 is a side elevation view of a cylinder from FIGS. 2 and 3 with covers removed.

The cylinder 2 has two transfer channels 10 close to the outlet, the transfer channels 10 issuing into the combustion chamber 3 by way of transfer windows 52, and two transfer channels 11 remote from the outlet, the transfer channels 11 issuing into the combustion chamber 3 by way of transfer windows 53. The transfer channels 10 and 11 are each arranged symmetrically with respect to a central plane of the cylinder 2. The central plane 21 is shown in FIG. 4 and corresponds to the section plane in FIG. 1. In each case two transfer channels 10 and 11 arranged on one side of the central plane 21 are merged in the cylinder to form a common section 41. The common section 41 runs into a region between the outlet 19 and the crankcase 4. The common section 41 passes over into the crankcase 4 at a transfer opening 23 on the cylinder base 13. In that section of the transfer channels 10 and 11 which is arranged below the outlet 19, all of the transfer channels (10, 11) of the cylinder 2 are merged. All of the transfer channels (10, 11) pass over into the crankcase 4 at the common transfer opening 23, and open into the crankcase interior space 8 at a common outlet opening 54.

As shown in FIG. 1, the transfer channels 10 and 11 partially run in helical form about the cylinder longitudinal axis. The longitudinal direction of the transfer channels 10 and 11 is inclined with respect to the cylinder longitudinal axis 12. In this way, in the case of the cylinder 2 being produced in a die casting process, the transfer channels 10 and 11 cannot be demolded in a downward direction, that is, parallel to the cylinder longitudinal axis 12.

Figure 2:
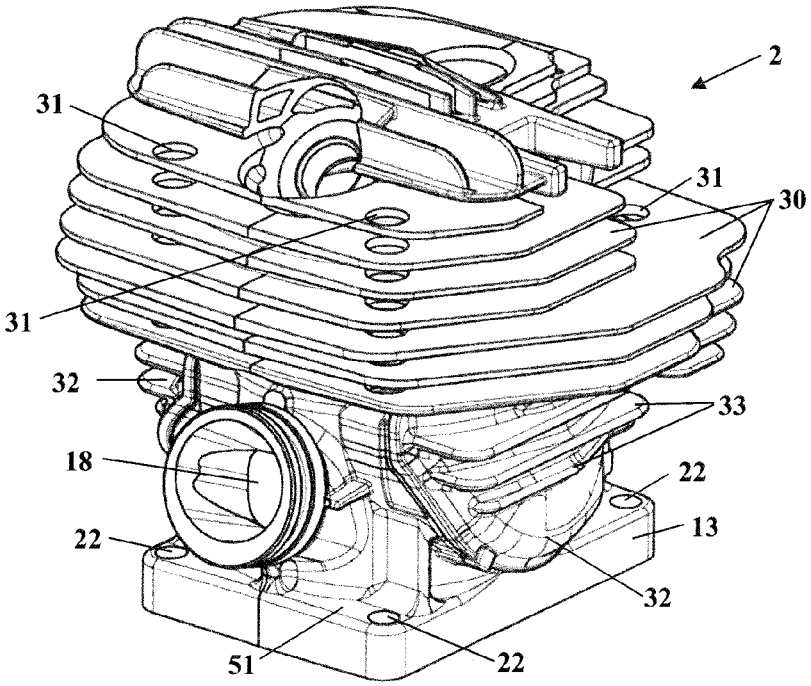
FIG. 2 is a perspective view of a cylinder of a two-stroke engine.

FIG. 2 shows the cylinder 2 in a perspective illustration. As shown in FIG. 2, two covers 32 are mounted onto the cylinder 2. The covers respectively cover a transfer channel 10 and a transfer channel 11 toward the cylinder outer side. As shown in FIG. 2, the cylinder base 13 has a top side 51 situated so as to be facing away from the crankcase 4. The cover 32 ends above the top side 51 of the cylinder base 13. In this case, the direction "upward" relates to a position of the two-stroke engine 1 in which the cylinder longitudinal axis 12 is oriented vertically and the crankcase 4 is arranged below the combustion chamber 3. This corresponds to the position of the two-stroke engine 1 shown in FIG. 1. As also shown in FIG. 2, the cylinder base 13 has holes 22 at which the cylinder 2 is fixedly screwed to the crankcase 4. In order that the fastening screws are easily accessible, holes 31 are provided in those cooling ribs 30 of the cylinder 2 which are situated above the holes 22.

Figure 3:
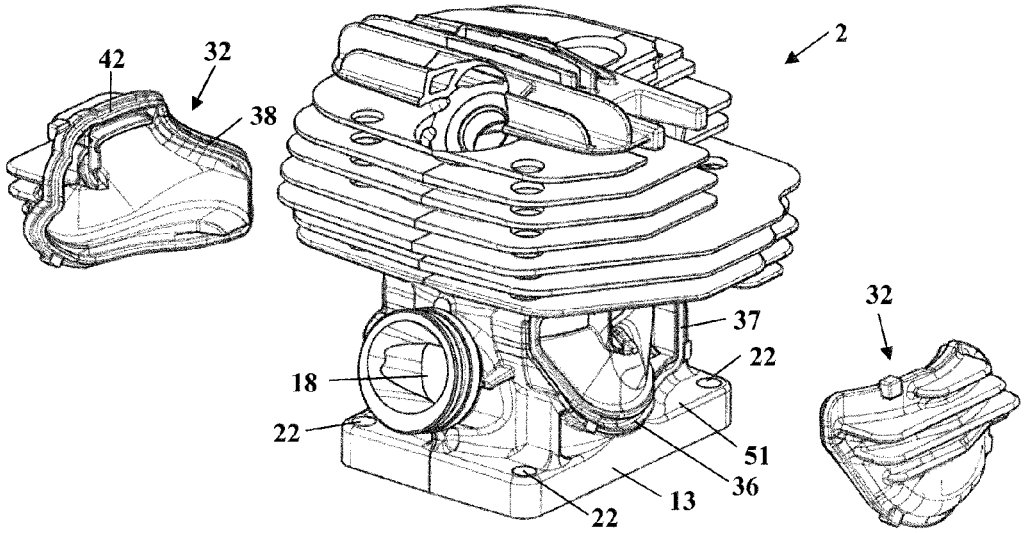
FIG. 3 is a perspective exploded schematic of the cylinder from FIG. 2.

FIG. 3 shows the cylinder 2 with covers 32 removed. As shown in FIG. 3, two covers 32 are provided on opposite sides of the central plane 21, shown in FIG. 4, of the cylinder 2. The central plane 21 is in this case a plane which encompasses the cylinder longitudinal axis 12 and which intersects the outlet 19 from the combustion chamber 3. The central plane 21 is preferably a plane of symmetry of the cylinder 2. The covers 32 are formed, and arranged on the cylinder 2, symmetrically with respect to the central plane 21. As shown in FIG. 3, the cylinder 2 has a sealing edge 36 on which a cover 32 lies by way of a sealing edge 42. The sealing edge 36 on the cylinder 2 has an encircling groove 37 into which an encircling web 38 of the cover 32 projects. This yields a good seal of the cover 32 on the cylinder 2. The covers 32 are preferably fastened to the cylinder 2 by adhesive bonding. In this case, the adhesive is advantageously arranged in the gap between sealing edge 36 and groove 37.

FIG. 4 also shows the groove 37 in the sealing edge 36 of the cylinder 2, and the arrangement of the sealing edge 36 above the top side 51 of the cylinder base 13. As is also schematically shown in FIG. 4, the common sections 41 of respective pairs of transfer channels 10 and 11 arranged on respective sides of the central plane 21 are merged, below the outlet 19, to form a common section 47. The common section 47 runs parallel to the cylinder longitudinal axis 12, wherein, in the common section 47, the transfer channels (10, 11) widened slightly in the direction of the crankcase 4 (FIG. 1). In this way, the cylinder 2 being produced in a die casting process, the common section 47 can be demolded from a core which is pulled in the direction of the crankcase 4 in the direction of the cylinder longitudinal axis 12.

Figure 5:
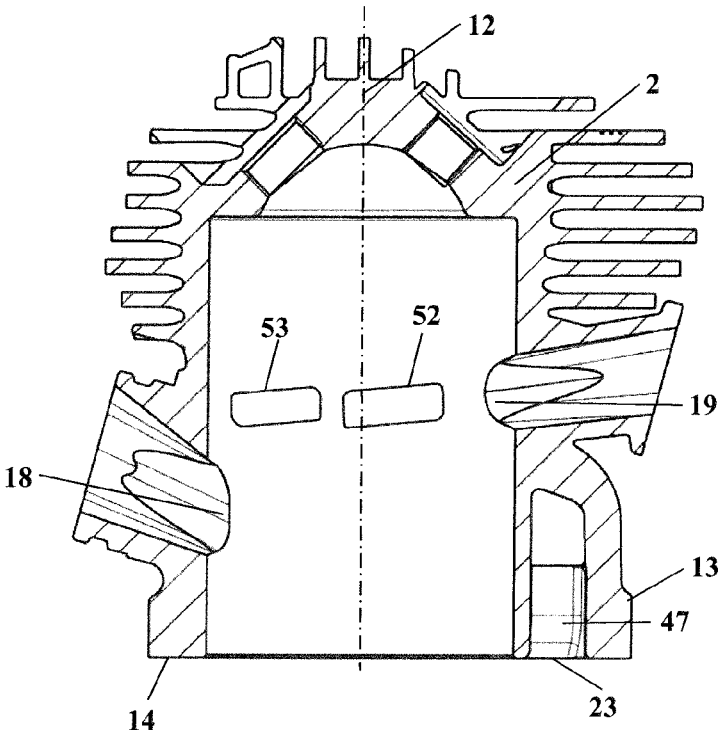
FIG. 5 shows a section through the cylinder from FIGS. 2 to 4.

As is also shown in FIG. 5, the common section 47 runs entirely through the cylinder base 13 and opens out at the partition plane 14 at the transfer opening 23. The common section 47 also runs parallel to the cylinder longitudinal axis 12 in the section plane shown in FIG. 5, which corresponds to the central plane 21.

Figure 6:
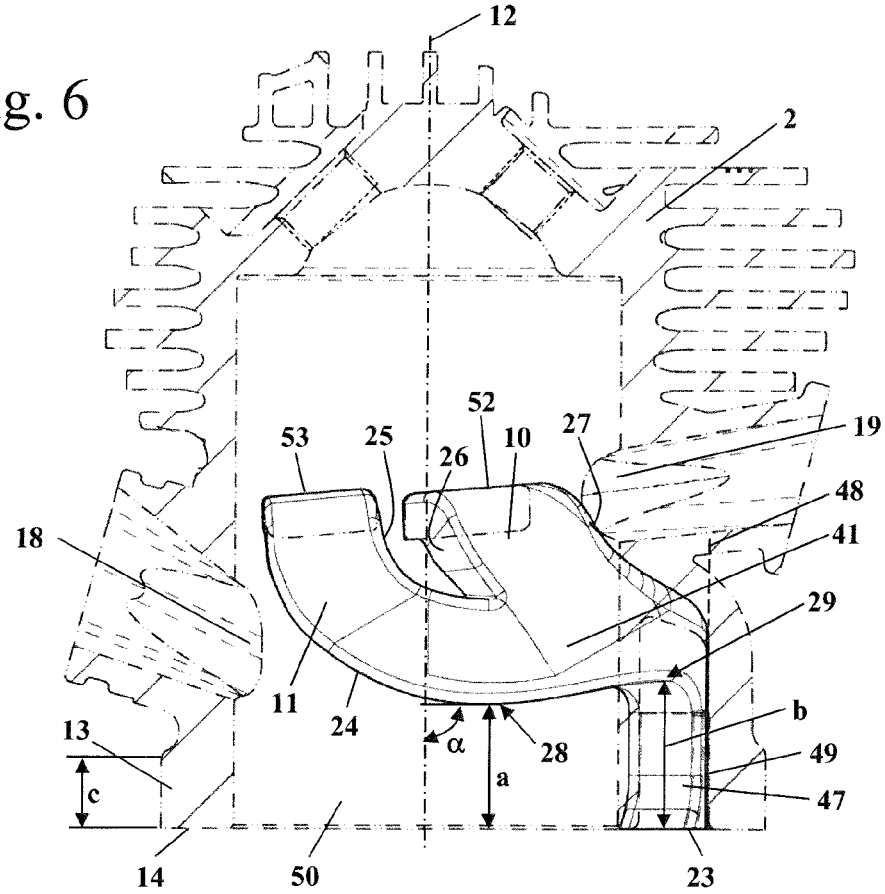
FIG. 6 is a schematic of the profile of the transport channels in the cylinder from FIG. 5.

FIG. 6 shows the profile of the transfer channels (10, 11) in detail. The transfer channels 11 remote from the outlet have a side wall 24 which delimits the transfer channels 11 in the cylinder circumferential direction in the direction of the inlet 18 and toward the partition plane 14 in the direction of the cylinder longitudinal axis 12. At their side situated opposite in the circumferential direction, and facing toward the outlet 19, the transfer channels 11 are delimited by a second side wall 25. The transfer channels 10 are delimited, on the side situated so as to face toward the transfer channels 11, by a side wall 26. The side walls 25 and 26 converge on one another, specifically at the location at which the common section 41 begins. The side walls 25 and 26 separate the transfer channels 10 and 11 from one another in the circumferential direction in the sections adjoining the transfer windows 52 and 53. The transfer channel 10 close to the outlet has a side wall 27 at its side which is situated so as to face toward the outlet 19 and which runs approximately in the vertical direction of the cylinder 2. The side walls 24, 25, 26 and 27 are oriented approximately in the radial direction toward the cylinder longitudinal axis 12 and delimit the transfer channels (10, 11) in the circumferential direction. Owing to the helical profile of the transfer channels, the side walls 24 to 27 are inclined with respect to the cylinder longitudinal axis 12. Owing to the curved profile of the transfer channel 11, that side wall 24 of the transfer channel 11 which is remote from the outlet also delimits the transfer channel 11 in the direction of the crankcase 4.

As shown in FIG. 6, the side wall 24 has a first region 28, which in the viewing direction perpendicular to the central plane 21 as shown in FIG. 6, runs perpendicular to the cylinder longitudinal axis 12. The first region 28 of the side wall 24 encloses an angle $\alpha$ of 90° with the cylinder longitudinal axis 12. The first region 28 has a spacing (a) to the partition plane 14. In the direction of the transfer opening 23, the spacing of the first side wall increases from the first region 28 to a second region 29. In the embodiment, the second region 29 is arranged close to the common section 47. The second region 29 has a spacing (b) to the partition plane 14, the spacing (b) being greater than the spacing (a). The spacing (b) is advantageously at least 10%, in particular at least 20%, greater than the spacing (a). The difference between the spacings (a) and (b) is preferably at least 3 mm, in particular at least 5 mm. It is also the case in the second region 29 that, in a viewing direction perpendicular to the central plane, the side wall 24 runs perpendicular to the cylinder longitudinal axis 12. The side wall 24 may, in the regions 28 and 29, be inclined with respect to the radial direction with respect to the longitudinal central axis 12. The spacing (a) of the first region 28 is greater than the thickness (c) of the cylinder base 13, as shown in FIG. 6.

Figure 7:
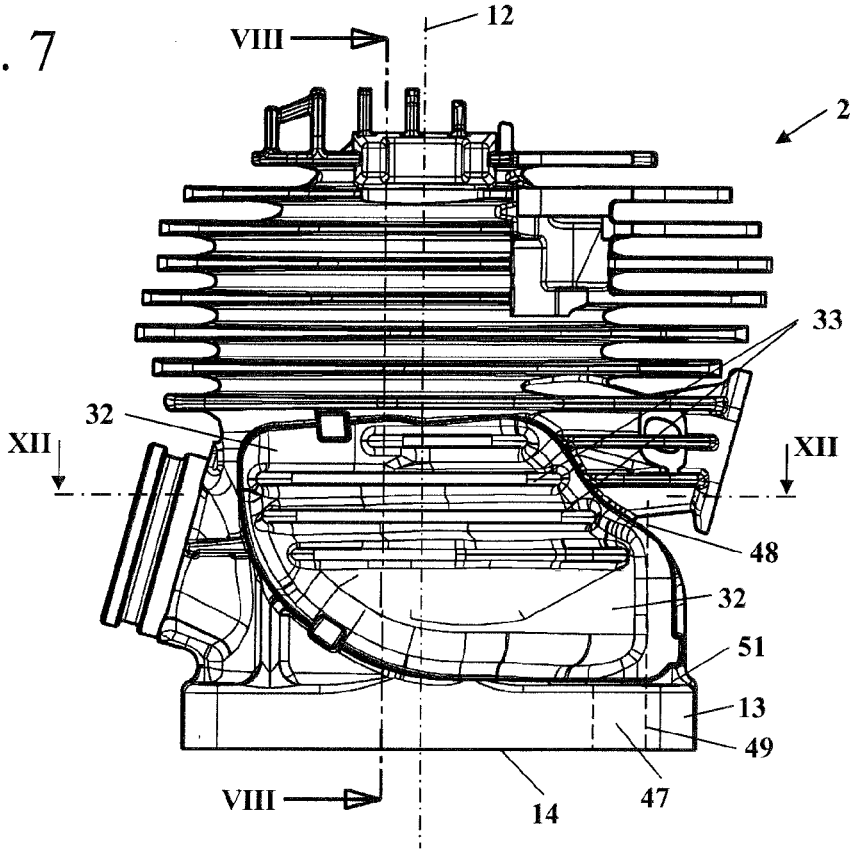
FIG. 7 is a side elevation view of the cylinder with covers arranged thereon.

As shown in FIG. 6, in the side view shown in FIG. 6, that is, in a viewing direction perpendicular to the central plane 21, the common section 47 has a vertical edge 49 which is situated so as to face away from the cylinder interior space 50. In the embodiment, the vertical edge 49 runs parallel to the cylinder longitudinal axis 12. In this viewing direction, the cylinder 2 has an imaginary line 48 which forms the elongation of the vertical edge 49. As shown in FIG. 7, in a side view with a viewing direction perpendicular to the central plane 21, the cover 32 extends beyond the vertical edge 49. In this way, the transfer channels (10, 11) can, with the exception of the common section 47 projecting through the cylinder base 13, be demolded entirely to the side, that is, with a pulling direction of the cores perpendicular to the central plane 21.

As shown in FIG. 7, the cover 32 has a multiplicity of cooling ribs 33. The cover 32 is advantageously likewise formed as a die cast part.

Figure 8:
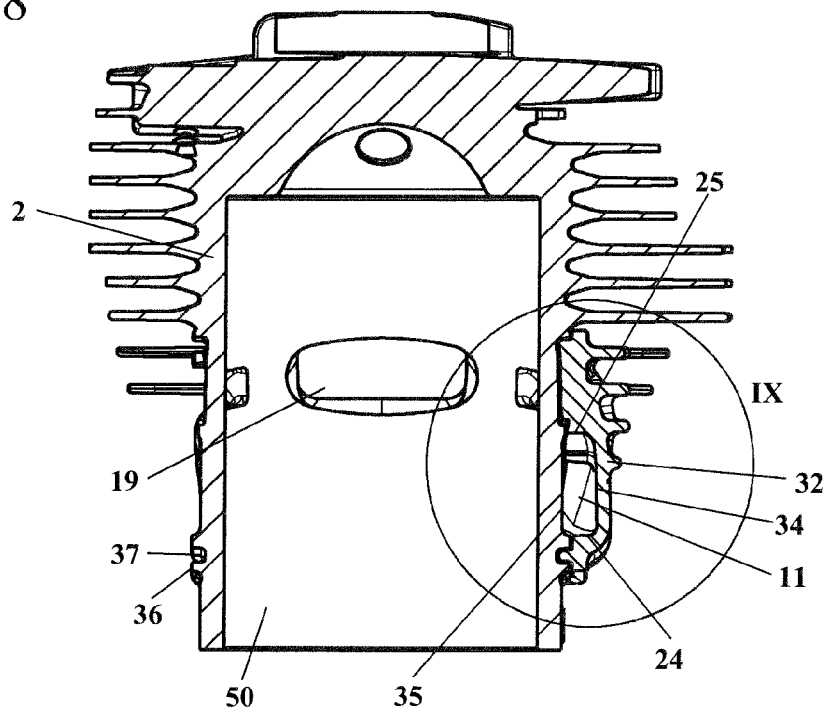
FIG. 8 shows a section along the line VIII-VIII in FIG. 7.
Figure 9:
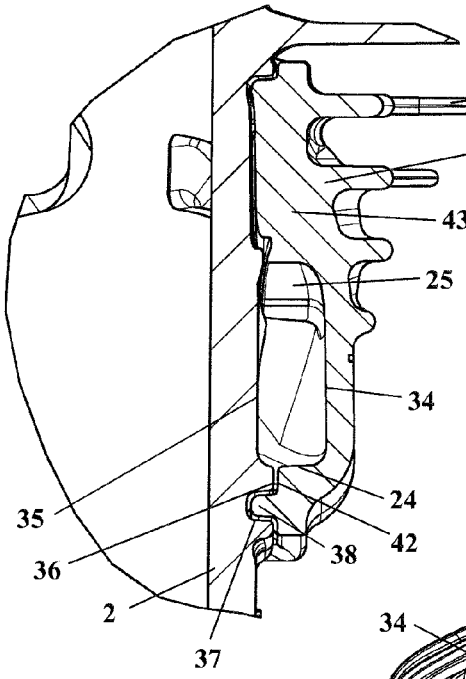
FIG. 9 shows the detail IX from FIG. 8 in an enlarged illustration.

FIGS. 8 and 9 show the delimitation of the transfer channel 11 in detail. As shown in FIG. 8, an inner wall 35 of the transfer channels 10 and 11, which inner wall delimits the transfer channels in the direction of a cylinder interior space 50, is formed by the cylinder 2. In the embodiment, the side wall 24 and the side wall 25 are formed in the cover 32. The cover 32 also delimits the transfer channel 11 toward the cylinder outer side which is situated so as to be averted from the cylinder interior space 50. For this purpose, an outer wall 34 of the transfer channel 11 is formed on the cover 32.

FIG. 9 shows the configuration of the sealing edges 36 and 42 in detail. As shown in FIG. 9, the web 38 projects into the groove 37 at the sealing edge 42. The cover 32 has a partition web 43 which separates the transfer channels 10 and 11 from one another in their sections adjoining the transfer windows 52 and 53 (FIG. 1).

Figure 10:
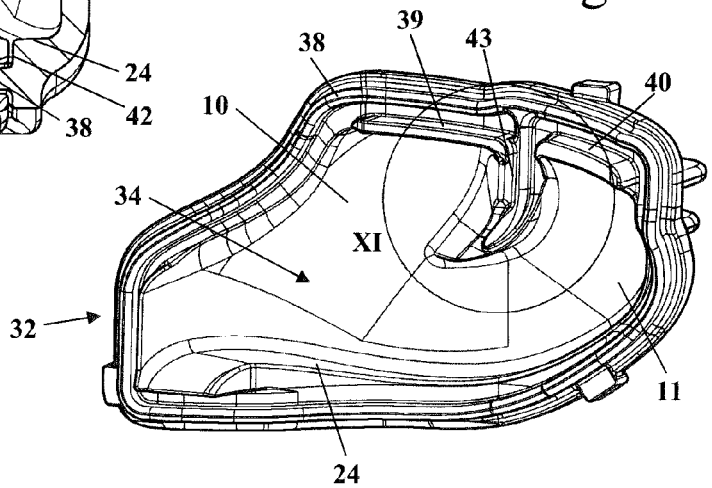
FIG. 10 is a perspective view of a cover of the two-stroke engine.

As shown in FIG. 10, a roof 39 of the transfer channel 10 and a roof 40 of the transfer channel 11 are also formed on the covers 32. The roofs 39 and 40 delimit the transfer channels (10, 11), adjacent to the transfer windows 52 and 53 (FIG. 1), on the side situated so as to be averted from the crankcase 4.

Figure 11:
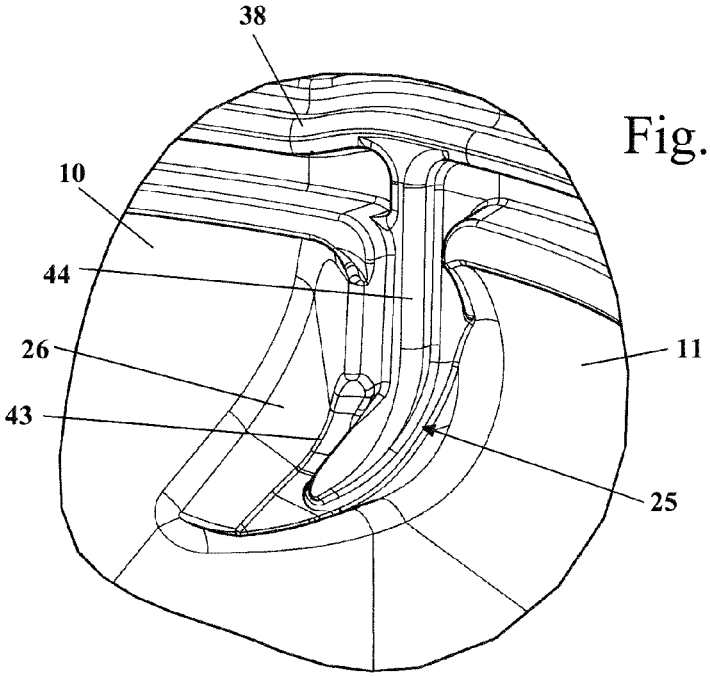
FIG. 11 shows the detail XI from FIG. 10 in an enlarged illustration.
Figure 12:
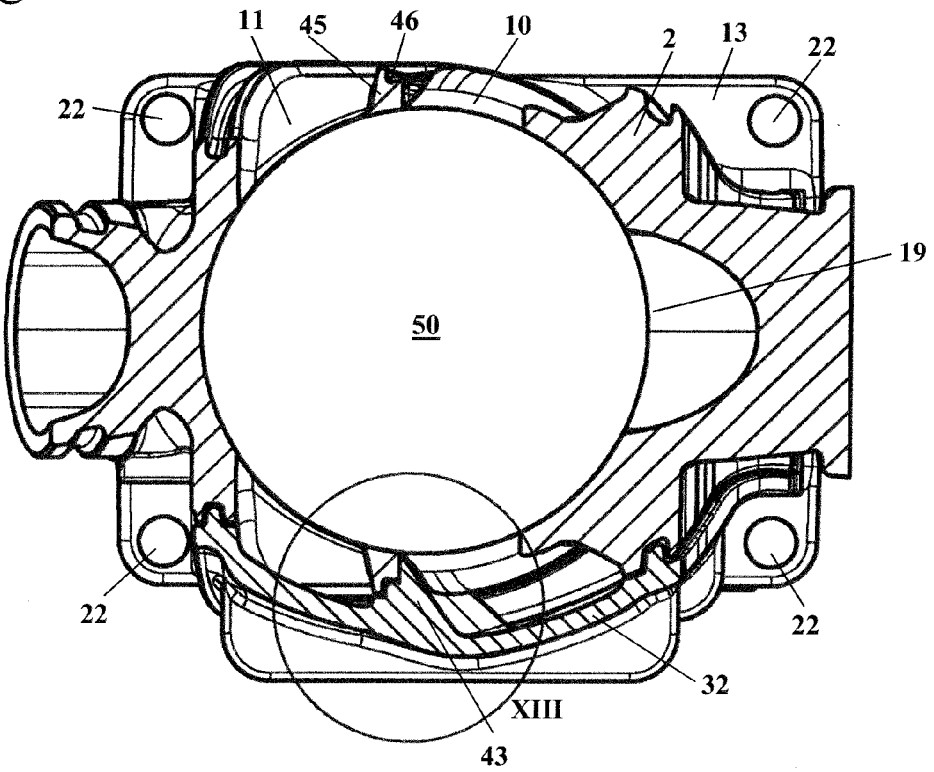
FIG. 12 shows a section along the line XII-XII in FIG. 7.
Figure 13:
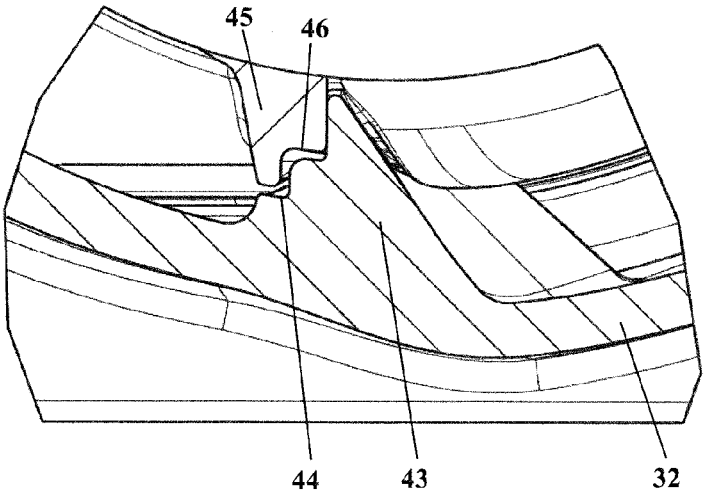
FIG. 13 shows the detail XIII from FIG. 12 in an enlarged illustration; and, FIG. 14 shows an embodiment of a cylinder in a side elevation view without covers arranged thereon.

FIG. 11 shows the configuration of the partition web 43 in detail. The partition web 43 has, on its face side situated so as to face toward the cylinder, a step 44 which runs in the longitudinal direction of the partition web 43. As shown in FIG. 12, the cylinder 2 has a partition web 45 which extends between the transfer channels 10 and 11. The partition web 45 has, on its outwardly facing face side, a step 46 which extends in the longitudinal direction of the partition web 45. As shown in FIG. 13, the steps 44 and 46 are situated closely adjacent to one another and thereby form a labyrinthine seal between the transfer channels 10 and 11 adjacent to the transfer windows 52 and 53. It is advantageously also the case that adhesive is arranged on the partition web 43 in the gap formed between the steps 44 and 46. The partition web 43 and 45 delimit an adhesive gap which runs between the transfer channels 10 and 11. The adhesive is advantageously arranged over the entire length of the partition webs 43 and 45 as far as the bifurcation of the transfer channels 10 and 11. By virtue of the fact that the transfer channels 10 and 11 are separated from one another in an effective manner in the region adjoining the transfer windows 52 and 53, it is possible to realize different effective lengths of the transfer channels 10 and 11, even though the transfer channels have common sections 41 and 47.

Figure 14:
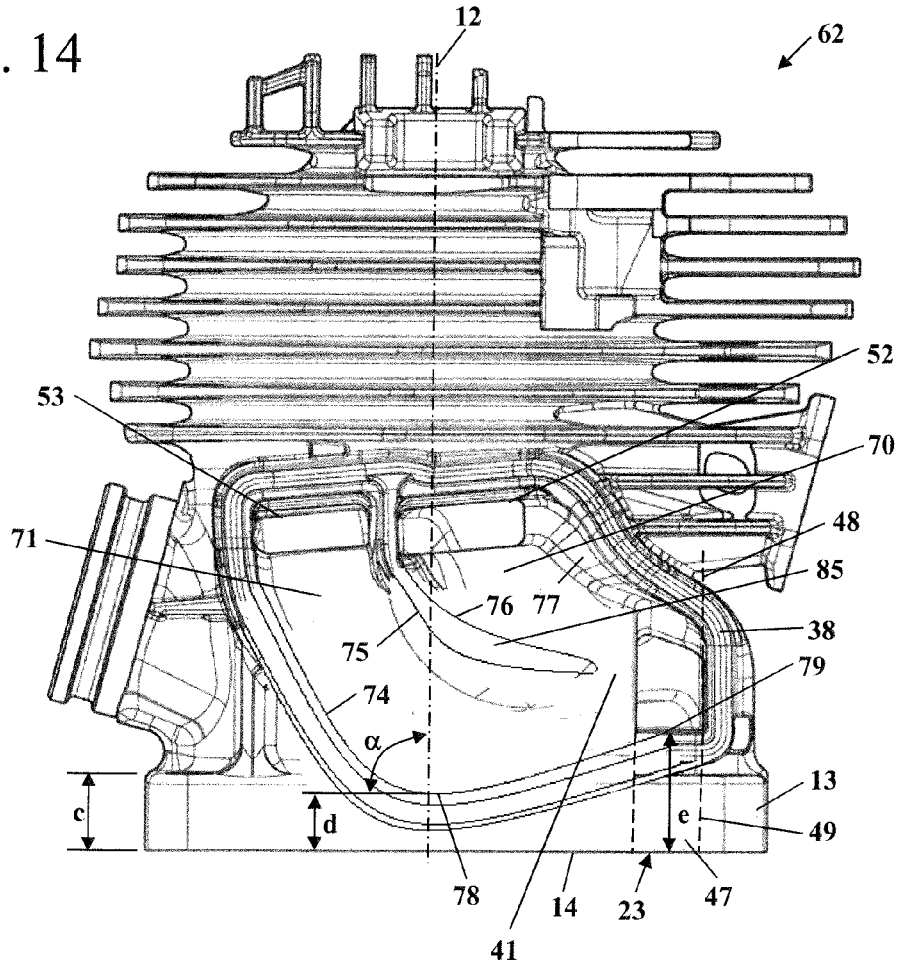

FIG. 14 shows a further embodiment of the cylinder 62. The construction of the cylinder 62 substantially corresponds to that of the cylinder 2. The cylinder 62 may be provided instead of the cylinder 2 in the two-stroke engine 1 shown in FIG. 1. In this case, identical reference signs are used in all of the figures to denote corresponding elements.

The cylinder 62 has one pair of transfer channels 70 close to the outlet and one pair of transfer channels 71 remote from the outlet and one transfer channel of each pair is shown in FIG. 14. The two transfer channels 70 and the two transfer channels 71 are in each case formed symmetrically with respect to one another. The transfer channel 71 is delimited by side walls 74 and 75, and the transfer channel 70 is delimited by side walls 76 and 77. In this case, the side walls 74 to 77 correspond approximately to the side walls 24 to 27, and at least partially delimit the transfer channels in the circumferential direction. As shown in FIG. 14, the first side wall 74 also delimits the transfer channel 71 toward the crankcase 4 in the direction of the cylinder longitudinal axis 12.

The side wall 74 has a first region 78 in which the side wall 74 is inclined by angle $\alpha$ of 90° with respect to the cylinder longitudinal axis 12. In the first region 78, the side wall 74 has a spacing (d) to the partition plane 14. In that region of the transfer channel 71 which runs between the first region 78 and the transfer opening 23, the side wall 74 rises again in the direction of the common section 49, such that the spacing of the side wall 74 to the partition plane 14 also increases. The side wall 74 has a second region 79 in which the side wall 74 has a spacing (e) to the partition plane 14. The spacing (e) is considerably greater than the spacing (d). The spacing (e) may advantageously amount to at least 110%, in particular at least 120%, preferably at least 130%, of the spacing (d). In the embodiment as per FIG. 14, the spacing (d) is smaller than a thickness (c), measured parallel to the cylinder longitudinal axis 12, of the cylinder base 13. The spacing (e) is considerably greater than the thickness (c) of the cylinder base 13. As is also shown in FIG. 14, a partition web 85 which is of relatively long form runs between the transfer channels 70 and 71 in the sections adjoining the transfer windows 52 and 53. The transfer channels 70 and 71 are thus merged for the first time in the region of the cylinder base 13, directly upstream of the common section 49. The common section 41 is thus relatively short. As is also shown in FIG. 14, the transfer channel 71 remote from the outlet is considerably longer than the transfer channel 70 close to the outlet. The considerably greater length of the transfer channel 71 is achieved inter alia by way of the curved profile of the side wall 74.

It is understood that the foregoing description is that of the preferred embodiments of the invention and that various changes and modifications may be made thereto without departing from the spirit and scope of the invention as defined in the appended claims.

What is claimed is:

1. A two-stroke engine comprising:

a cylinder defining a cylinder longitudinal axis and having a combustion chamber formed therein;

a piston mounted in a reciprocating manner;

said combustion chamber having an outlet and being delimited by said piston;

a crankcase defining a crankcase interior space;

a crankshaft rotatably mounted about a rotational axis in said crankcase;

said piston being configured to drive said crankshaft;

said cylinder having a cylinder base whereat said cylinder base and said crankcase conjointly define a partition plane separating said cylinder from said crankcase;

the two-stroke engine defining an imaginary central plane which contains said rotational axis and intersects said outlet;

at least one transfer channel having at least one side wall;

said combustion chamber being fluidly connected to said crankcase interior space via said at least one transfer channel in at least one position of said piston;

said at least one transfer channel passing from said cylinder to said crankcase via at least one transfer opening;

said at least one side wall having a first region in said cylinder;

said at least one side wall in said first region in a viewing direction perpendicular to said imaginary plane encloses an angle $\alpha$ of 90° with said cylinder longitudinal axis;

said first region of said side wall having a first distance (a, d) to said partition plane measured parallel to said cylinder longitudinal axis;

said at least one side wall having a second region running in a cylinder circumferential direction between said first region and said transfer opening;

said second region being at a second distance (b, e) to said partition plane measured parallel to said cylinder longitudinal axis; and, said second distance (b, e) being greater than said first distance (a, d).

2. The two-stroke engine of claim 1 further comprising at least one cover configured to close at least one of said at least one transfer channels with respect to the exterior of said cylinder.

3. The two-stroke engine of claim 2, wherein said transfer channel has a section adjoining said transfer opening and formed in said cylinder base; and, said section runs parallel to said cylinder longitudinal axis.

4. The two-stroke engine of claim 3, wherein said section of said transfer channel has a vertical edge facing away from the interior space of said cylinder; and, said cover, when viewing said cylinder in side elevation in a viewing direction perpendicular to said central plane, extends at least up to an imaginary line defining the extension of said vertical edge.

5. The two-stroke engine of claim 2, wherein:

said cylinder has a first circumferential sealing edge; and, said cover has a second circumferential sealing edge arranged on said first circumferential sealing edge.

6. The two-stroke engine of claim 5, wherein:

said cylinder base has a top side facing away from said partition plane; and, said first circumferential sealing edge running completely above said top side of said cylinder base when said cylinder longitudinal axis is arranged perpendicularly and said combustion chamber is arranged above said crankcase.

7. The two-stroke engine of claim 1, wherein the two-stroke engine has at least two transfer channels arranged on one side of said imaginary central plane which merge with each other in said cylinder and open into said crankcase interior space at a common opening.

8. The two-stroke engine of claim 7 further comprising:

a cover; and, said two transfer channels arranged on one side of said imaginary central plane are both closed by said cover.

9. The two-stroke engine of claim 8, wherein said transfer channels have a common section; and, said cover at least partially covers said common section.

10. The two-stroke engine of claim 1, wherein the two-stroke engine has at least two transfer channels arranged symmetrically to said imaginary central plane.

11. The two-stroke engine of claim 1, wherein the two-stroke engine has at least two transfer channels disposed on opposite sides of said imaginary central plane opening into said crankcase at a common transfer opening.

12. The two-stroke engine of claim 1, wherein said at least one of said transfer channel runs at least partially helically about said cylinder longitudinal axis.

13. The two-stroke engine of claim 1, wherein said partition plane runs perpendicular to said cylinder longitudinal axis and is arranged between said rotational axis of said crankshaft and said combustion chamber.

14. The two-stroke engine of claim 1 further comprising:

at least one crankshaft bearing having a side facing said combustion chamber;

said crankshaft being rotatably mounted via said at least one crankshaft bearing; and, said partition plane running on said side of said crankshaft bearing without intersecting said bearing.

* * * * *